US008789537B2

(12) United States Patent
Loredo

(10) Patent No.: US 8,789,537 B2
(45) Date of Patent: Jul. 29, 2014

(54) DOUBLE HAIR CLIP AND METHOD OF USE

(71) Applicant: Mirza Loredo, Bronx, NY (US)

(72) Inventor: Mirza Loredo, Bronx, NY (US)

( * ) Notice: Subject to any disclaimer, the term of this patent is extended or adjusted under 35 U.S.C. 154(b) by 0 days.

(21) Appl. No.: 13/726,283

(22) Filed: Dec. 24, 2012

(65) Prior Publication Data

US 2013/0160784 A1 Jun. 27, 2013

Related U.S. Application Data

(60) Provisional application No. 61/580,350, filed on Dec. 27, 2011.

(51) Int. Cl.

| | |
|---|---|
| ***A45D 24/00*** | (2006.01) |
| ***A45D 7/00*** | (2006.01) |
| ***A45D 24/06*** | (2006.01) |
| ***A45D 8/00*** | (2006.01) |
| ***A45D 8/22*** | (2006.01) |
| ***A45D 8/28*** | (2006.01) |
| ***A45D 8/30*** | (2006.01) |
| *A45D 8/20* | (2006.01) |
| *A45D 8/32* | (2006.01) |
| *A45D 8/38* | (2006.01) |

(52) U.S. Cl.

CPC ... *A45D 8/28* (2013.01); *A45D 8/20* (2013.01); *A45D 8/30* (2013.01); *A45D 8/32* (2013.01); *A45D 8/38* (2013.01)

USPC ..... 132/200; 132/133; 132/273; 132/278; 132/279

(58) Field of Classification Search

CPC ..... A45D 8/12; A45D 8/14; A45D 8/20; A45D 8/22; A45D 8/24; A45D 8/26; A45D 8/28; A45D 8/30; A45D 8/32; A45D 8/34; A45D 8/36; A45D 8/38

USPC ..... 132/133, 200, 201, 210, 212, 213.1, 132/219, 105, 106, 107, 126–132, 134–142, 132/144–146, 148, 151, 273, 275–279, 54, 132/55; 24/509–511; D28/21–23, 25, D28/27–29, 32–34, 39, 42, 43, 93, 10, 31, D28/40, 41; 119/600, 601, 607, 611–613, 119/614, 615, 616, 619, 625

See application file for complete search history.

(56) References Cited

U.S. PATENT DOCUMENTS

| | | | | | |
|---|---|---|---|---|---|
| 573,887 | A | * | 12/1896 | Kraus | 132/133 |
| 613,145 | A | * | 10/1898 | Herrick et al. | 132/273 |
| 622,568 | A | * | 4/1899 | Touchtermann | 132/133 |
| 673,098 | A | * | 4/1901 | Tissier | 132/133 |
| 904,411 | A | * | 11/1908 | Damon | 132/106 |
| 918,203 | A | * | 4/1909 | Schwarzer | 132/133 |
| 1,596,737 | A | * | 8/1926 | Johnson | 132/133 |
| 2,569,659 | A | * | 10/1951 | Dombek | 132/133 |
| 3,998,233 | A | * | 12/1976 | Dorr | 132/279 |

(Continued)

*Primary Examiner* — Vanitha Elgart

(74) *Attorney, Agent, or Firm* — Gloria Tsui-Yip; Wendi E. Uzar

(57) ABSTRACT

A hair accessory device; in particular, a device and method of use that is uniquely configured to clamp and securely grasp hair in place and allow the hair to appear fuller. The device is a double hair clip having a corresponding pair of pivotable jaws, an inner set and an outer set. This advantageously allows for the secure holding of hair while creating the look of hair fullness.

19 Claims, 11 Drawing Sheets

(56) References Cited

U.S. PATENT DOCUMENTS

| | | | | | |
|---|---|---|---|---|---|
| 5,174,312 | A * | 12/1992 | Adams | 132/273 |
| 5,335,680 | A * | 8/1994 | Moore | 132/276 |
| 5,477,870 | A * | 12/1995 | Menaged | 132/279 |
| 5,590,668 | A * | 1/1997 | Macy | 132/200 |
| 5,669,399 | A * | 9/1997 | Camp et al. | 132/273 |
| 5,833,335 | A * | 11/1998 | Voughlohn | 132/273 |
| 5,937,867 | A * | 8/1999 | Williams | 132/201 |
| 6,311,699 | B1 * | 11/2001 | Horman | 132/278 |
| 6,484,728 | B1 * | 11/2002 | Chang | 132/133 |
| D483,523 | S * | 12/2003 | Jones | D28/40 |
| 7,222,631 | B2 * | 5/2007 | Silva | 132/277 |
| 7,581,547 | B2 * | 9/2009 | Pena | 132/275 |
| 2006/0096609 | A1 * | 5/2006 | Nwokola | 132/201 |
| 2007/0283976 | A1 * | 12/2007 | Adams | 132/133 |
| 2008/0035164 | A1 * | 2/2008 | Callahan | 132/200 |
| 2010/0012140 | A1 * | 1/2010 | Fitzpatrick | 132/200 |
| 2010/0018544 | A1 * | 1/2010 | Hsu | 132/279 |
| 2010/0078036 | A1 * | 4/2010 | Naji | 132/200 |
| 2010/0252059 | A1 * | 10/2010 | Peverini | 132/120 |
| 2011/0120490 | A1 * | 5/2011 | King | 132/210 |

* cited by examiner

DOUBLE HAIR CLIP AND METHOD OF USE

FIELD OF THE INVENTION

This invention relates to hair accessories. In particular, an improved device is disclosed that is uniquely configured to clamp and securely grasp hair in place and allow the hair to appear fuller and the method of use.

BACKGROUND OF THE INVENTION

Hair accessory devices are commonly designed to hold and secure hair in a desired position. These devices include hair clips, elastic bands, barrettes, plastic spring loaded devices, etc. However, these devices have some limitations. One limitation is that many clips and barrettes will not securely grasp hair and hold it in the desired position. Hair is capable of slipping out of the teeth of such clips which requires the user to remove and reattach the clip. Another common limitation is that users who have fine hair do not achieve a hairstyle having the fullness they desire.

Therefore, there is a need for a hair accessory device that allows for secure holding of hair while creating the look of hair fullness.

SUMMARY OF THE INVENTION

The present invention is a double hair clip for securely fastening hair and providing a hairstyle to make hair appear more full.

The double hair clip of the present invention comprises a corresponding pair of pivotable jaws, an inner set and an outer set, each having a retaining end and a pivotable end.

The pivotable ends of the inner set of jaws are pivotally connected. The retaining ends of the inner set of jaws are capable of abutting each other and retaining a portion of hair therein. The retaining ends may further comprise a clasping means which are capable of clasping together. Said inner set of jaws having an inside surface and an outside surface, a plurality of hair holding means, such as teeth extend from the inside and outside surfaces of the inner set of jaws.

A connecting member extends from the pivotable end of the inner set of jaws and attaches to a corresponding pair of outer set of jaws.

Each of the outer set of jaws comprises a retaining end and a pivotable end. The pivotable end of the outer set of jaws are pivotally connected. The retaining ends of the outer set of jaws are capable of abutting each other and retaining a portion of hair therein. The retaining ends may further comprise a clasping means which are capable of clasping together. Said outer set of jaws having an inside surface and an outside surface, a plurality of teeth extend from the inside surface of the outer set of jaws.

The method of the present invention enhances the fullness of a hairstyle. The method comprises the steps of positioning a pivotable pair of inner jaws movable between an open position and a closed position, each jaw having a pivotable end and a retaining end, comprising a clasp at the retaining end, each jaw having an inside surface and an outside surface. The inside surface having teeth extending therefrom. Placing a first portion of hair inside the inner set of jaws and closing the clasp of the clasping means of the retaining ends of the inner jaws around the first portion of hair, gathering a second portion of hair around the closed inner jaws, positioning the pivotable pair of outer jaws, movable from an open position and a closed position, each jaw having a pivotable end and a retaining end, a clasp at the retaining end, each jaw having an inside surface and an outside surface, the inside surface having teeth extending therefrom, fastening the clasp of the retaining ends of the outer jaws around the second portion of hair.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
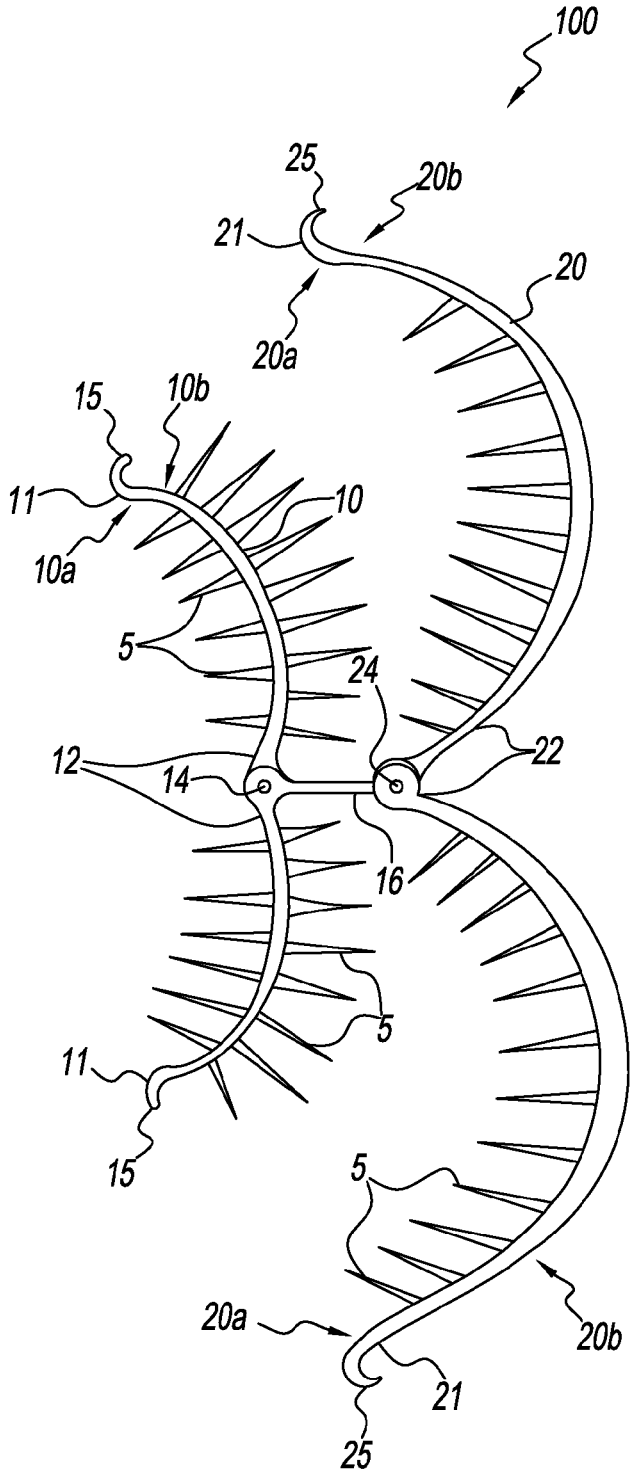
FIG. 1 is a side view of the double hair clip of the present invention.
Figure 2:
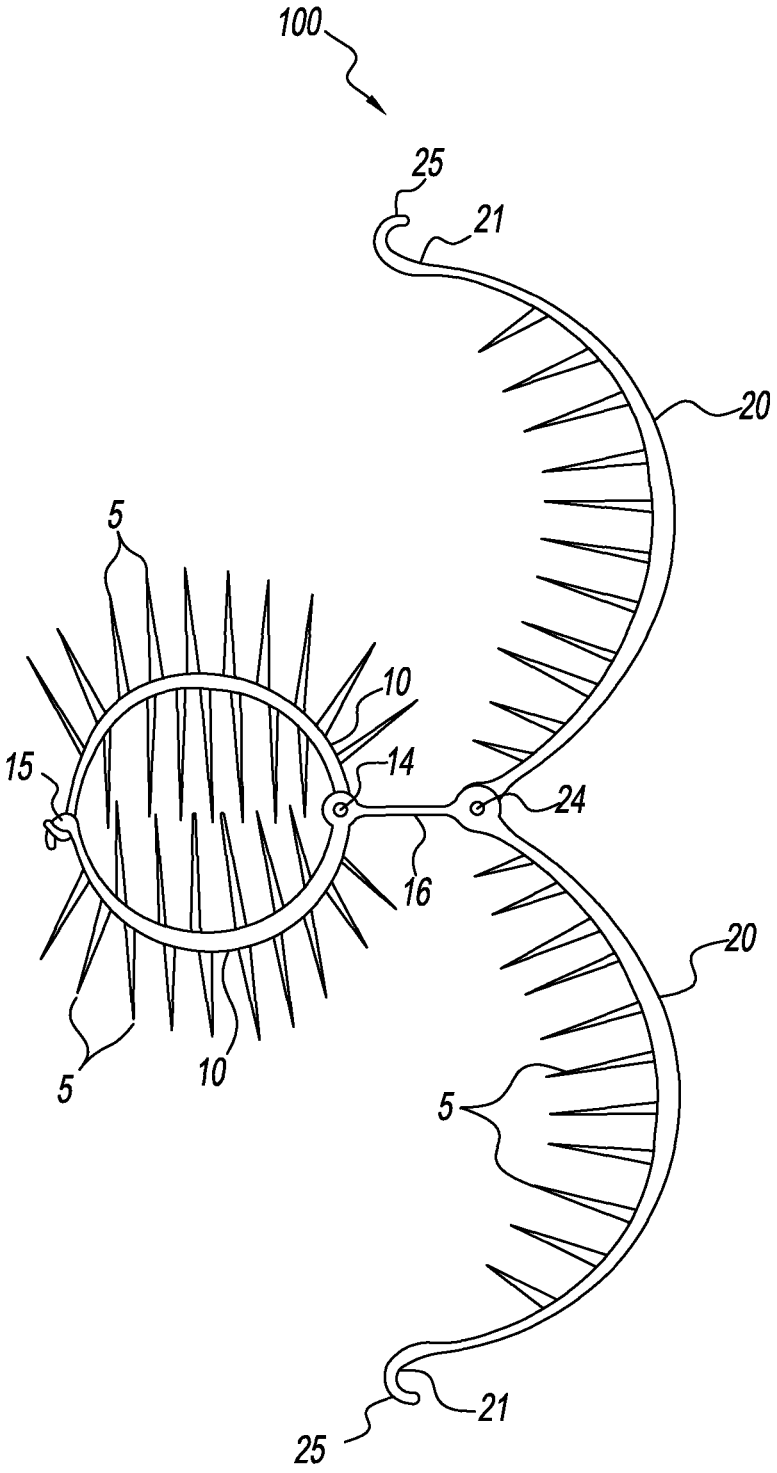
FIG. 2 is a side view of the double hair clip of the present invention, wherein the inner set of jaws are in the closed position.

With reference to the drawings, wherein the same reference number indicates the same element throughout, there is shown in FIG. 1, a side view of the double hair clip 100 of the present invention. As shown in FIG. 1 the double hair clip 100 comprises a corresponding pair of jaws, an inner set of jaws 10 and an outer set of jaws 20. Each of the inner set of jaws 10 has a retaining end 11 and a pivotable end 12. Each of the outer set of jaws 20 has a retaining end 21 and a pivotable end 22. The pivotable ends 12 of the inner set of jaws 10 are pivotally connected to each other by a pin 14 with enlarged heads. The inner set of jaws 10 are movable from an open position to a closed position. The retaining ends 11 of the inner set of jaws 10 are capable of abutting each other and retaining a portion of hair therein. The retaining ends 11 of the inner set of jaws 10 may further comprise a clasping means so that the respective retaining ends are capable of clasping together by clasp 15 when in a closed position. Each of the inner set of jaws 10 have an inside surface 10*a* and an outside surface 10*b*. The inside surfaces 10*a* of the inner set of jaws 10 have equally spaced apart teeth 5 extending therefrom. The outside surfaces 10*b* of the inner set of jaws 10 have equally spaced apart teeth 5 extending therefrom. As shown in FIG. 2, the teeth 5 are spaced apart so they are capable of interlocking and interacting with each other when the inner set of jaws 10 are in the closed position, but other teeth spacing can be used. In the preferred embodiment of the present invention the inner set of jaws 10 are each substantially semi-circular, but other shapes can also be used.

As shown in FIG. 1, the double hair clip 100 comprises a connection member 16 having a first end and a second end. The first end of the connection member 16 attaches to the pivotable ends 12 of the inner set of jaws 10. The second end of the connection member 16 attaches to the outer set of jaws 20 at its pivotable ends 22. The connection member 16 may be of varying length and shape (e.g. straight, curved, wavy, zigzag, etc.). The pivotable ends 22 of the outer set of jaws 20 are pivotally connected to each other by pin 24 with enlarged heads. The outer set of jaws 20 are movable from an open position to a closed position. The retaining ends 21 of the outer set of jaws 20 are capable of abutting each other and retaining a second portion of hair therein. The retaining ends 21 of the outer set of jaws 20 may further comprise a clasping means so that the respective retaining ends are capable of clasping together by clasp 25 when in a closed position. Each of the outer set of jaws 20 have an inside surface 20*a* and an outside surface 20*b*. The inside surfaces 20*a* of the outer set of jaws 20 have equally spaced apart teeth 5 extending therefrom, however other teeth spacing can be used. In the preferred embodiment of the present invention the outer set of jaws 20 are each substantially semi-circular, but other shapes can also be used.

It is contemplated that the inner set of jaws 10 and the outer set of jaws 20 may have different shapes such as square, rectangular or oval, etc. It is also contemplated that the inner set of jaws 10 may have one shape, such as a circle, and the outer set of jaws 20 may have another shape such as a square. The clasping means and clasps (15, 25 or 35) of the inner set of jaws 10 and the outer set of jaws 20 may be any removably fastening means known to one skilled in the art, such as corresponding hooks, latch and hook, corresponding Velcro® hooks and eyes, magnetic clasps, etc.

FIG. 2 shows the inner set of jaws 10 being held in a closed position by clasp 15 while the outer set of jaws 20 is in an open position.

Figure 3:
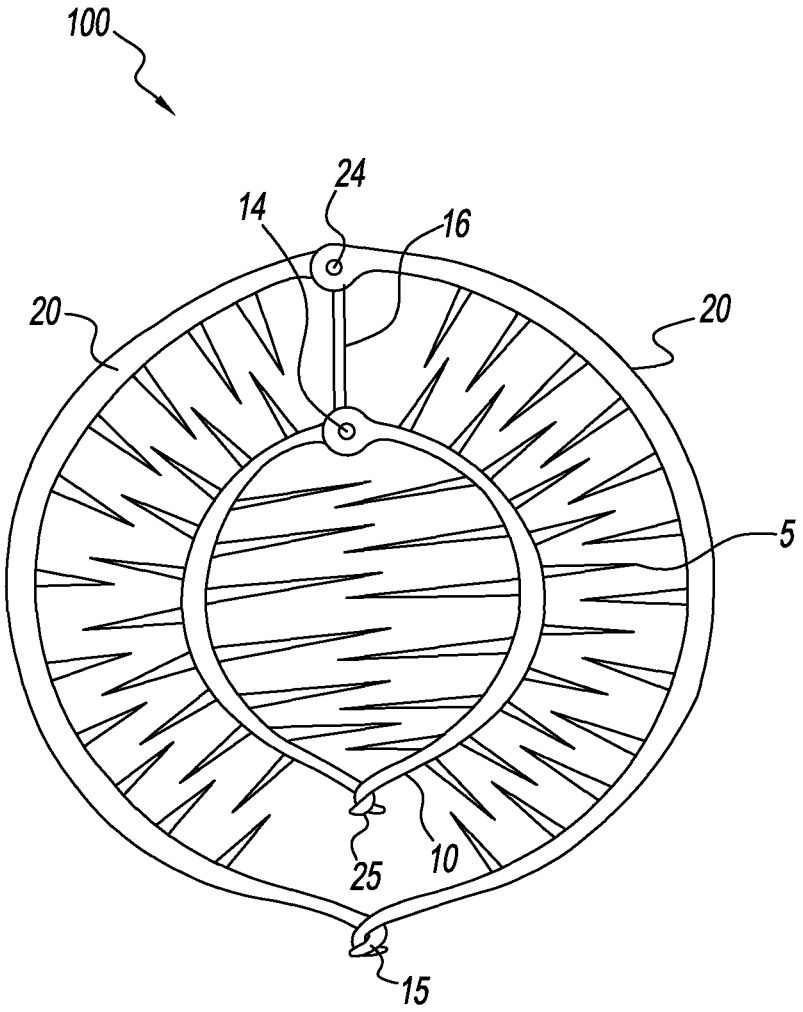
FIG. 3 is a side view of the double hair clip of the present invention, wherein the inner set of jaws and the outer set of jaws are in the closed position.

FIG. 3 shows the inner set of jaws 10 in a closed position and the outer set of jaws 20 in the closed position.

The method of the present invention for enhancing the fullness of a hairstyle using hair clip 100 or 102 comprises the steps of positioning a pivotable pair of inner jaws 10 movable between an open position and a closed position, each jaw having a pivotable end 12 and a retaining end 11, a clasping means such as clasp 15 at the retaining end 11, each jaw having an inside surface 10*a* and an outside surface 10*b*. The inside surfaces 10*a* having teeth 5 extending therefrom. Placing a first portion of hair inside the inner set of jaws 10 and closing the retaining ends 11, which can be accomplished with clasps 15 of the retaining ends 11 of the inner jaws 10 around the first portion of hair, gathering a second portion of hair around the closed inner jaws 10, positioning the pivotable pair of outer jaws 20, movable from an open position and a closed position, each jaw having a pivotable end 22 and a retaining end 21, a clasping means at the retaining ends 21, each jaw having an inside surface 20*a* and an outside surface 20*b*, the inside surfaces 20*a* having teeth 5 extending therefrom, fastening the clasping means such as clasp 25 of the retaining ends 21 of the outer jaws 20 around the second portion of hair.

Figure 4:
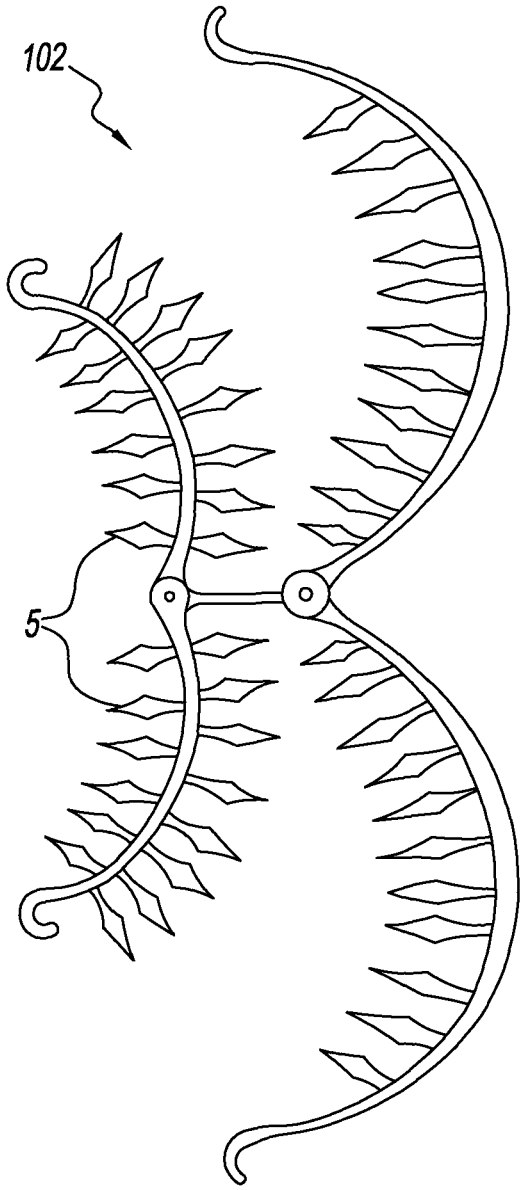
FIG. 4 is a side view of the second embodiment of the present invention.
Figure 5:
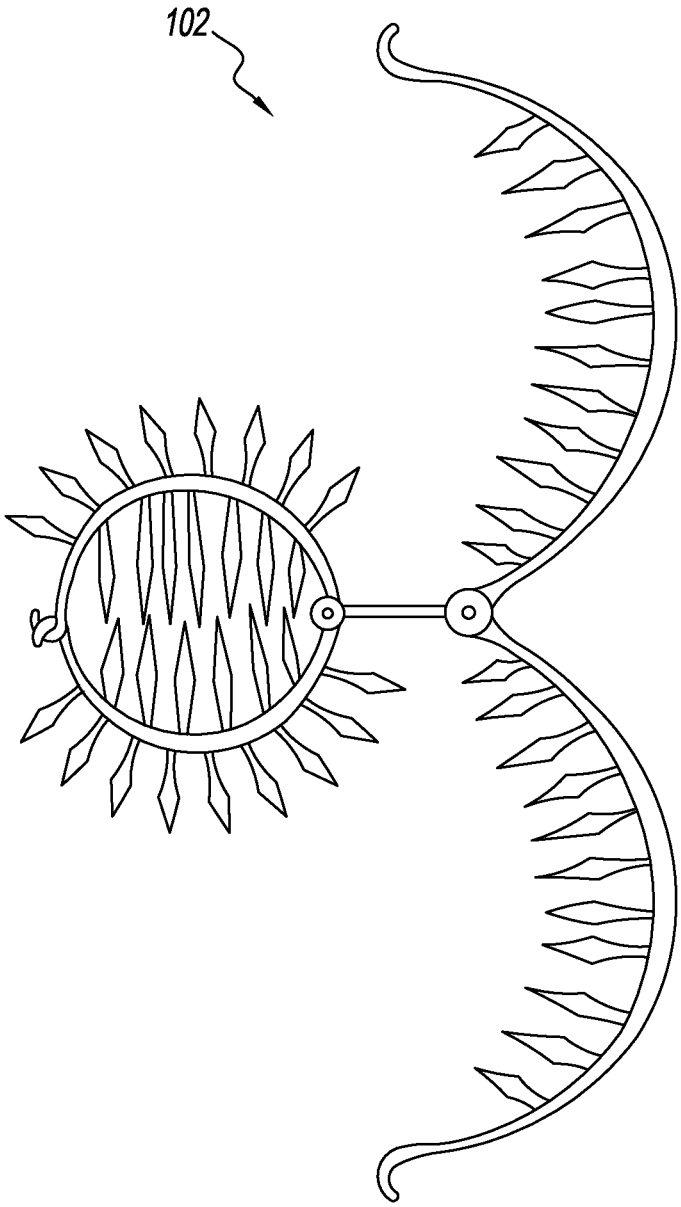
FIG. 5 is a side view of the double hair clip of the second embodiment of the present invention, wherein the inner set of jaws are in the closed position.
Figure 6:
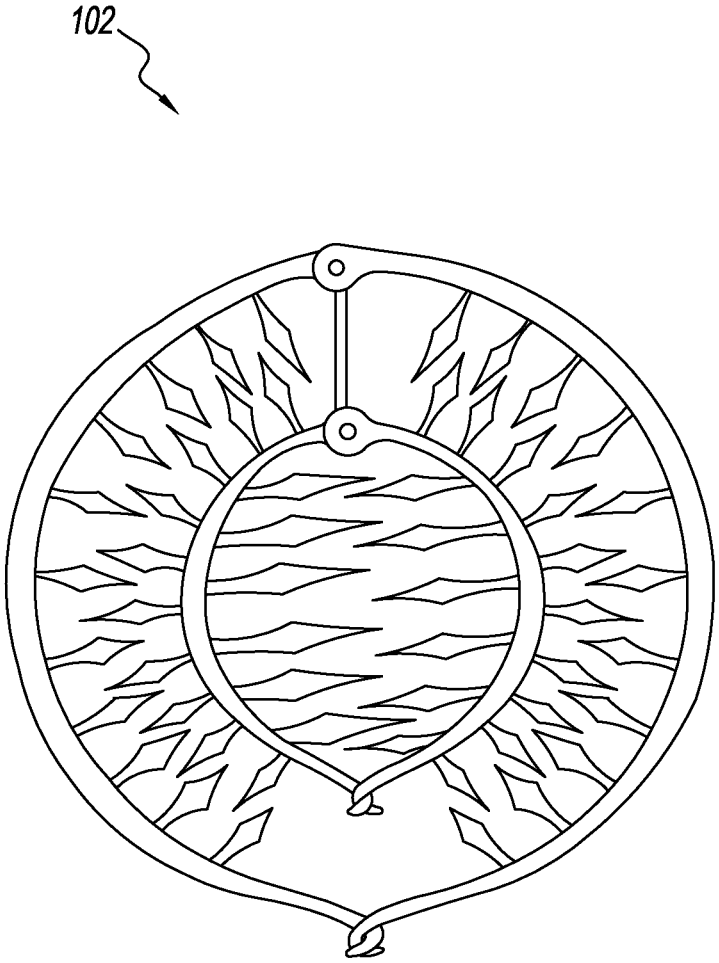
FIG. 6 is a side view of the double hair clip of the second embodiment of the present invention, wherein the inner set of jaws and the outer set of jaws are in the closed position.

As shown in FIGS. 4-6, the double hair clip 102 may have teeth 5 of different shapes, such as diamonds or pins, with varying sizes, lengths and widths. The length and width of the teeth 5 are sized to accommodate different users having different hair thickness, texture and length. It is contemplated that the teeth 5 may not be equally spaced apart but are set at random locations. It is further contemplated that the teeth 5 do not interlock when the inner set of jaws 10 and the outer set of jaws 20 are in the closed position, but instead are adjacent to or abut each other. The teeth 5 may be resilient to be able to engage the hair placed therebetween. The surface of each tooth 5 may be rough to prevent hair held therein from slipping out of the hair clip 100 or 102. Instead of teeth 5, other hair holding means known to one skilled in the art may be used, such as hooks, pins, Velcro® hooks and eyes, magnetic clasps etc.

Figure 9:
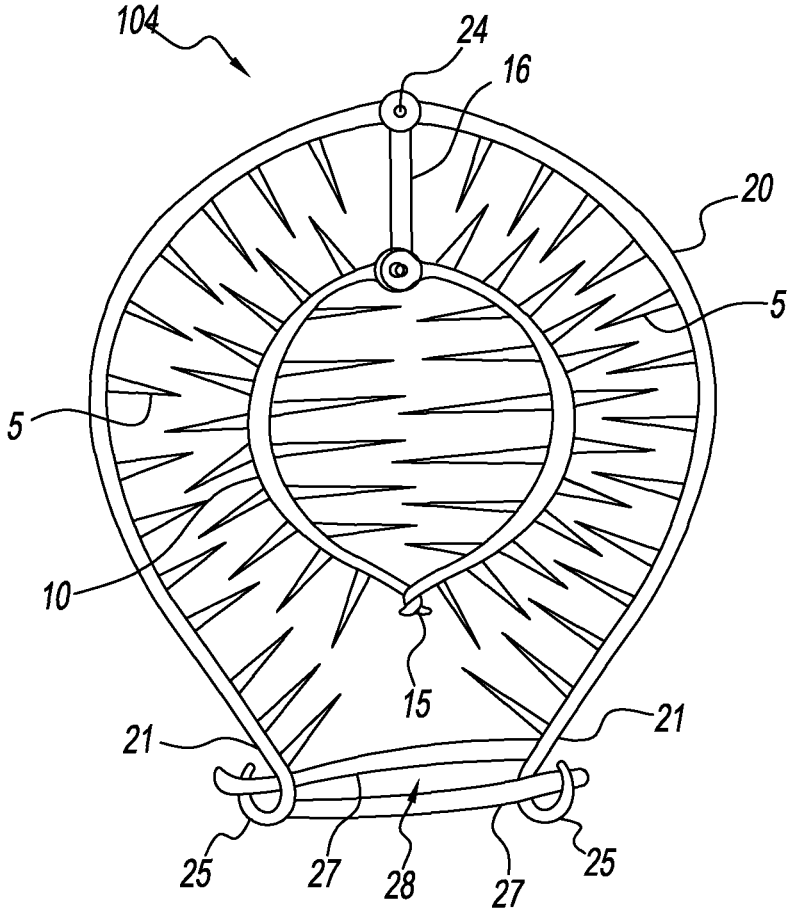
FIG. 9 is a side view of the double hair clip of the third embodiment of the present invention, wherein the inner set of jaws are in the closed position and the outer set of jaws are in the closed position.

As shown in FIG. 9, in an alternative embodiment of the present invention is the double hair clip 104. The outer set of jaws 20 are movable from an open position to a closed position. The retaining ends 21 of the outer set of jaws 20 may have clasping means such as clasps 25. The clasping means of the retaining ends 21 further comprise an arm element 27. The outer set of jaws 20 are capable of clasping together by securing the arm element 27 within the opposite clasp 25 when in a closed position. When each arm element 27 is secured to the opposite clasp 25, the arm elements 27 define a ring area 28.

The method of the alternative embodiment of the present invention using the hair clip 104 for enhancing the fullness of a ponytail comprises the steps of positioning a pivotable pair of inner jaws 10 movable between an open position and a closed position, each jaw having a pivotable end 12 and a retaining end 11, a clasping means such as clasp 15 at the retaining end 11, each jaw having an inside surface 10*a* and an outside surface 10*b*. The inside surface 10*a* having teeth 5 extending therefrom. Placing a first portion of hair inside the inner set of jaws 10 and closing the clasps 15 of the retaining ends 11 of the inner jaws 10 around the first portion of hair, gathering a second portion of hair around the closed inner jaws 10, positioning the pivotable pair of outer jaws 20, movable from an open position and a closed position, each jaw having a pivotable end 22 and a retaining end 21, a clasping means such as clasp 25 at the retaining end 21, each jaw having an inside surface 20*a* and an outside surface 20*b*, the inside surfaces 20*a* having teeth 5 extending therefrom, attaching the arm element 27 to the opposite clasp 25 of the retaining ends 21 of the outer jaws 20 around both the first and second portions of hair such that all the hair is positioned within the ring area 28.

Figure 11:
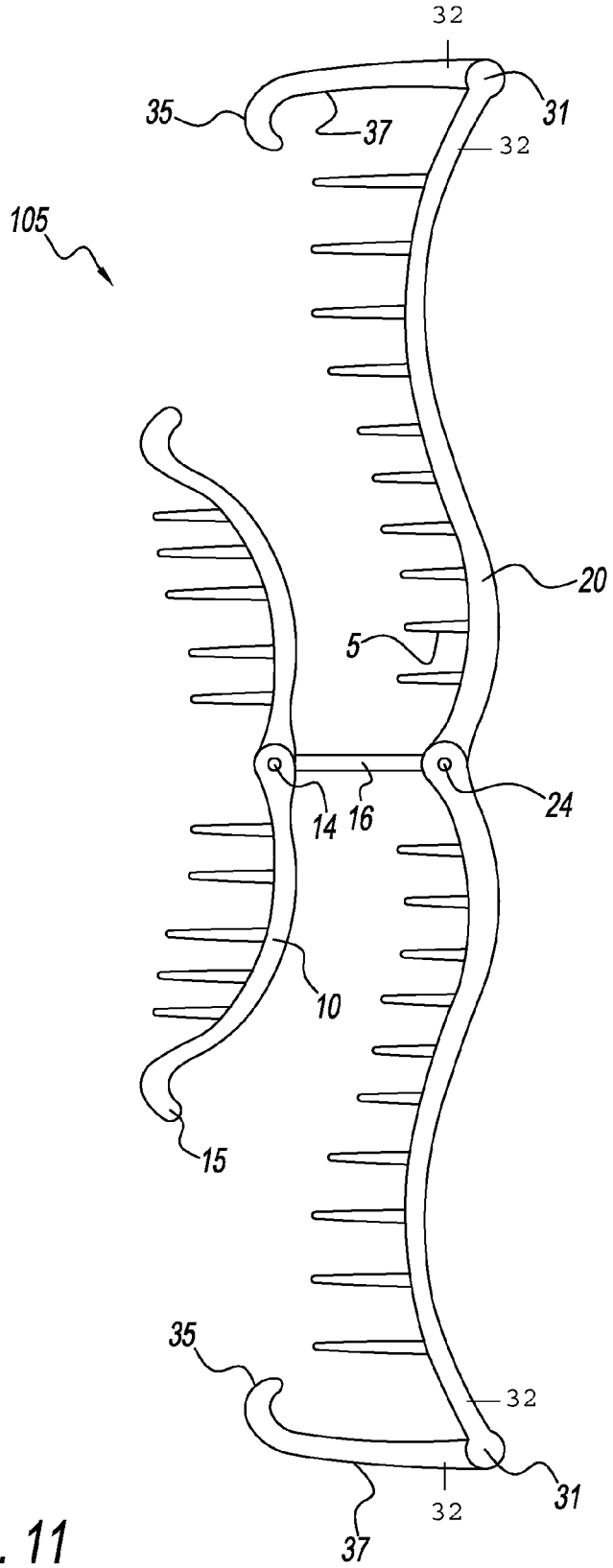
FIG. 11 is a side view of the double hair clip of the fourth embodiment of the present invention.
Figure 12:
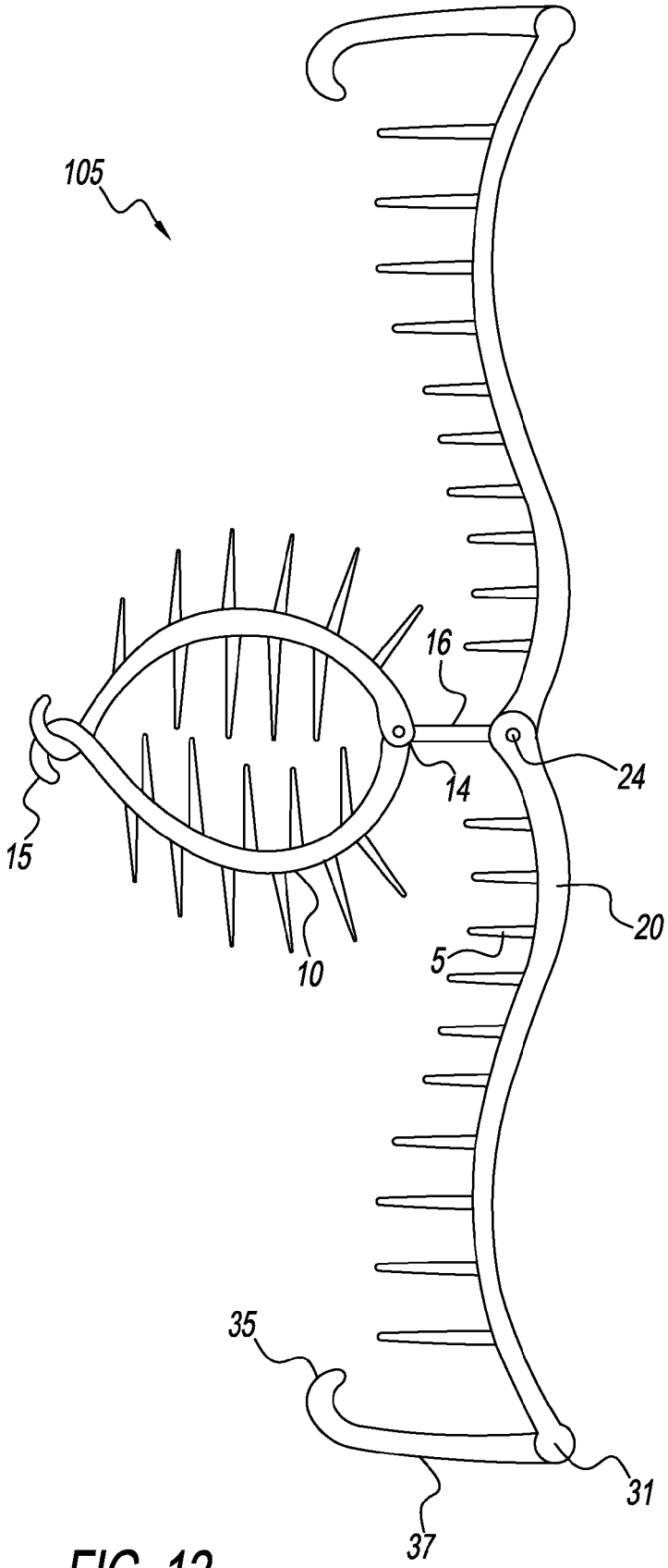
FIG. 12 is a side view of the double hair clip of FIG. 11, wherein the inner set of jaws is in the closed position.
Figure 13:
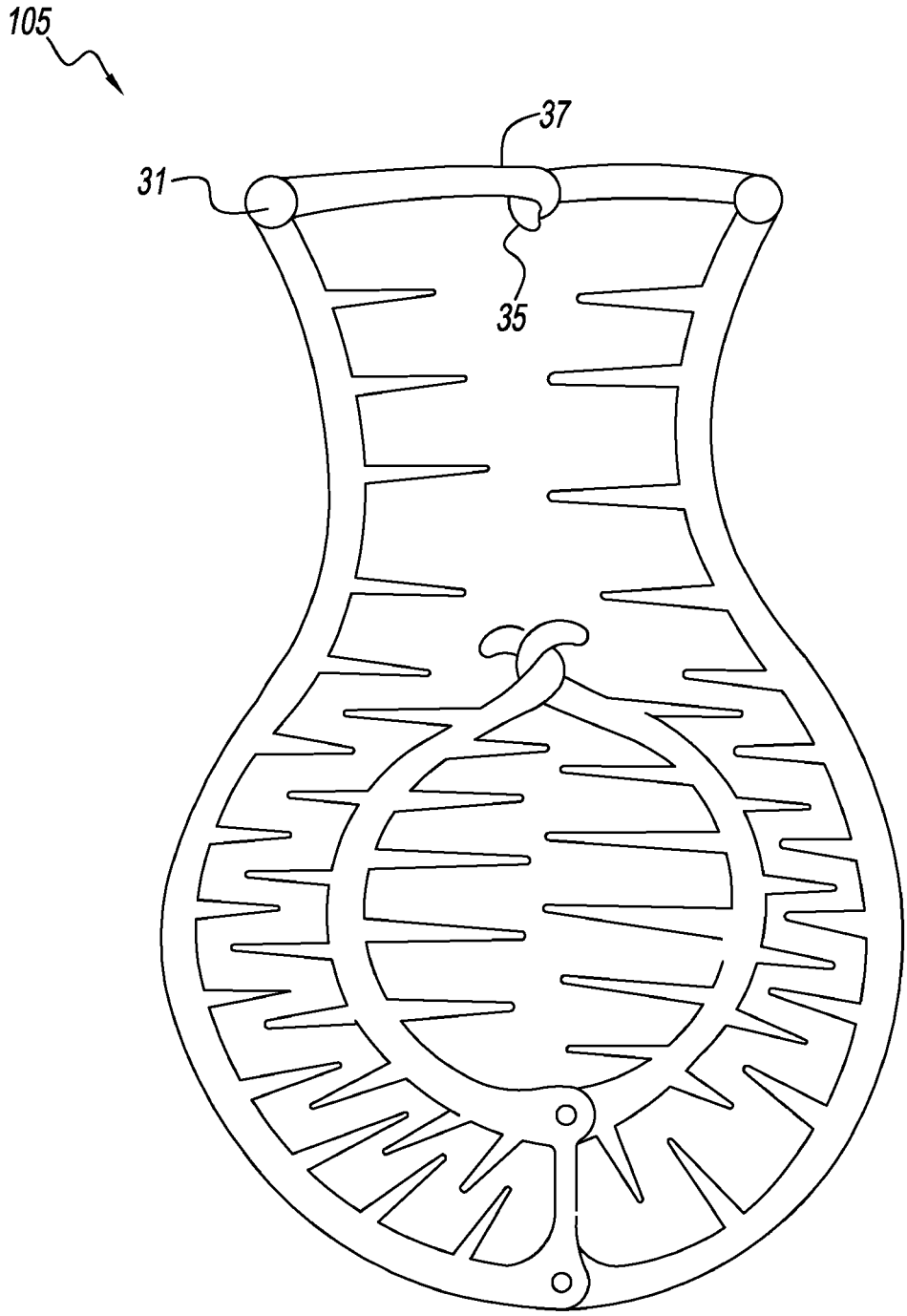
FIG. 13 is a side view of the double hair clip of FIG. 11, wherein the inner set of jaws and the outer set of jaws are in the closed position.

As shown in FIGS. 11-13, in an alternative embodiment of the present invention is the double hair clip 105. The outer set of jaws 20 is movable from an open position to a closed position. Each retaining end 31 of the outer set of jaws 20 has an arm element 37 with a clasp 35 at its distal end. The outer set of jaws 20 are capable of clasping together by securing the clasp 35 with the opposite clasp 35 when in a closed position. Arm element 37 may be pivotably or fixedly connected to the retaining end 31 of the outer set of jaws 20.

The method of the alternative embodiment of the present invention using the hair clip 105 for enhancing the fullness of a ponytail comprises the steps of positioning a pivotable pair of inner jaws 10 movable between an open position and a closed position, each jaw having a pivotable end 12 and a retaining end 11, a clasping means such as clasp 15 at the retaining end 11, each jaw having an inside surface 10*a* and an outside surface 10*b*. The inside surfaces 10*a* having teeth 5 extending therefrom. Placing a first portion of hair inside the inner set of jaws 10 and closing the clasps 15 of the retaining ends 11 of the inner jaws 10 around the first portion of hair, gathering the second portion of hair around the closed inner jaws 10, positioning the pivotable pair of outer jaws 20, movable from an open position and a closed position, each outer jaw having a pivotable end 22 and a retaining end 31 with an arm element 37 having a clasping means 35 at its distal end, each jaw having an inside surface 20*a* and an outside surface 20*b*, the inside surfaces 20*a* having teeth 5 extending therefrom, attaching the clasp 35 at the distal end of the arm element 37 to the opposite clasp 35 of the retaining ends 31 of the outer jaws 20 around the first and second portions of the hair.

The pivotable ends (12, 22 or 32) of the inner set of jaws 10 and the outer set of jaws 20 may also be any movable means known to one skilled in the art, such as hinges, corresponding boss and opening, corresponding gears, a hole, pin and spring or jaws made of a resilient material such that the jaws are biased towards each other but movable away from each other with force.

Figure 7:
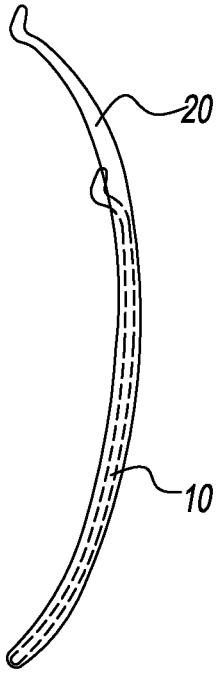
FIG. 7 is a front view of any embodiment of the double hair clip of the present invention.
Figure 8:
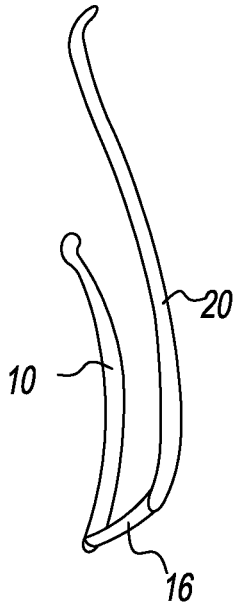
FIG. 8 is a front view of an alternative structure of any embodiment of the double hair clip of the present invention.
Figure 10:
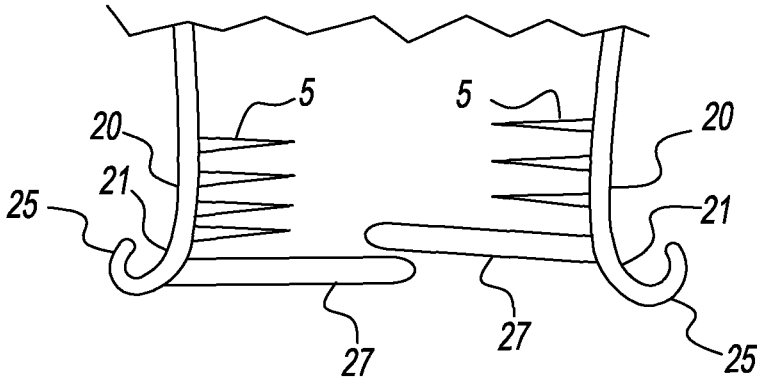
FIG. 10 is an enlarged view of the retaining ends of the outer set of jaws of FIG. 9.

The double hair clip 100, 102, 104 or 105 of the present invention may be made of plastic. In another embodiment of the present invention the double hair clip 100, 102, 104 or 105 is made of metal. It is further contemplated that the entire double hair clip 100, 102, 104 or 105 be made from rubber. The double hair clip 100, 102, 104 or 105 may be planar or curved with varying heights/thickness. A curved double hair clip 100, 102, 104 or 105, as shown in FIG. 7, allows the double hair clip 100, 102, 104 or 105 to be positioned closely adjacent a user's scalp. The inner set of jaws 10 and the outer set of jaws 20 may be on the same planar or curved surface or be offset from each other (as shown in FIG. 8) to achieve different hairstyling effects.

The features of the invention illustrated and described herein are the preferred embodiments. Therefore, it is understood that the specification is intended to cover unforeseeable embodiments with insubstantial differences that are within the spirit of the specification.

What I claim is:

1. A double hair clip comprising:

a) at least one inner set of jaws;

b) at least one outer set of jaws having an outer surface defining a perimeter, said outer set of jaws being larger than said inner set of jaws, wherein said inner set of jaws nests within said perimeter of said outer set of jaws;

c) at least one connection member connecting said inner set of jaws to said outer set of jaws;

d) wherein each jaw of said inner set of jaws having a retaining end capable of abutting each other and retaining a portion of hair therein;

e) wherein each jaw of said outer set of jaws having a retaining end capable of abutting each other and retaining a second portion of hair therein; and f) wherein said retaining ends of said outer set of jaws and said inner set of jaws having clasping means so that said respective retaining ends are capable of clasping together.

2. The double hair clip of claim 1 wherein said outer set of jaws and said inner set of jaws are made of a resilient material so that said retaining ends may be separated from each other to allow a portion of hair to be inserted therein.

3. The double hair clip of claim 1 wherein each said jaws of said inner set of jaws and each said jaws of said outer set of jaws having a pivotable end opposite said retaining ends; said pivotable ends of said inner set of jaws and said outer set of jaws being connected to each other respectively by a connection means.

4. The double hair clip of claim 1 wherein each of said inner set of jaws having an inside surface; said inside surfaces of said inner set of jaws having hair holding means extending therefrom.

5. The double hair clip of claim 1 wherein each of said outer set of jaws having an inside surface; said inside surfaces of said outer set of jaws having hair holding means extending therefrom.

6. The double hair clip of claim 1 wherein each of said inner set of jaws having an outside surface; said outside surfaces of said inner set of jaws having hair holding means extending therefrom.

7. The double hair clip of claim 4 wherein said hair holding means comprises a plurality of teeth.

8. The double hair clip of claim 7 wherein said plurality of teeth are equally spaced apart.

9. The double hair clip of claim 7 wherein said teeth are spaced apart so they are capable of interlocking and interacting with each other when the inner set of jaws are in said closed position.

10. The double hair clip of claim 1 wherein said inner set of jaws are each substantially semi-circular.

11. The double hair clip of claim 1 wherein said outer set of jaws are each substantially semi-circular.

12. The double hair clip of claim 1 wherein said clasping means comprises a clasp.

13. The double hair clip of claim 1 wherein said clasping means comprises an arm element and a clasp that are capable of clasping together.

14. A double hair clip comprising:

a) at least one inner set of jaws;

b) at least one outer set of jaws having an outer surface defining a perimeter, said outer set of jaws being larger than said inner set of jaws, wherein said inner set of jaws nests within said perimeter of said outer set of jaws;

c) at least one connection member connecting said inner set of jaws to said outer set of jaws;

d) wherein each set of jaws are capable of moving from an open position to a closed position;

e) wherein each jaw of said inner set of jaws having a retaining end capable of abutting each other and retaining a portion of hair therein when in a closed position;

f) wherein each jaw of said outer set of jaws having a retaining end capable of abutting each other and retaining a second portion of hair therein when in a closed position; and g) wherein said retaining ends of said outer set of jaws and said inner set of jaws having clasping means so that said respective retaining ends are capable of clasping together.

15. The double hair clip of claim 14 wherein each of said inner set of and said outer set of jaws having an inside surface and an outside surface; said inside surfaces of said inner set of jaws having hair holding means extending therefrom; said outside surfaces of said inner set of jaws having hair holding means extending therefrom; and said inside surfaces of said outer set of jaws having hair holding means extending therefrom.

16. A method for securely grasping hair in place and allowing the hair to appear fuller, comprising the steps of:

a) providing at least one inner set of each jaw of said inner set of having a retaining end capable of abutting each other;

b) providing at least one outer set of jaws having an outer surface defining a perimeter, said outer set of jaws being larger than said inner set of jaws wherein said inner set of jaws nests within said perimeter of said outer set of jaws, each jaw of said outer set of jaws having a retaining end capable of abutting each other;

c) providing at least one connection member connecting said inner set of jaws to said outer set of jaws;

d) placing a first portion of hair inside said inner set of jaws;

e) closing said retaining ends of said inner set of jaws around said first portion of hair;

f) placing a second portion of hair inside said outer set of jaws; and g) closing said retaining ends of said outer set of jaws around said second portion of hair.

17. The method of claim 16 wherein each retaining end having clasping means.

18. The method of claim 17 wherein said clasping means comprises a clasp.

19. The method of claim 16 wherein each of said inner set of jaws having an outside surface; said outside surfaces of said inner set of jaws having hair holding means extending therefrom.

* * * * *